US005765242A

United States Patent [19]

Marciano

[11] Patent Number: 5,765,242

[45] Date of Patent: Jun. 16, 1998

[54] HAND SANITIZING APPARATUS

[76] Inventor: Joseph Marciano, 210 Park Dr., Eastchester, N.Y. 10709

[21] Appl. No.: 719,311

[22] Filed: Sep. 24, 1996

Related U.S. Application Data

[63] Continuation of Ser. No. 346,863, Nov. 30, 1994, abandoned.

[51] Int. Cl.[6] ..... E03C 1/05

[52] U.S. Cl. ..... 4/623; 4/628

[58] Field of Search ..... 4/619, 623, 628

[56] References Cited

U.S. PATENT DOCUMENTS

| | | | |
|---|---|---|---|
| 1,494,883 | 5/1924 | Bassette et al. . | |
| 1,765,915 | 6/1930 | Haase . | |
| 2,504,740 | 4/1950 | Siegel . | |
| 3,358,747 | 12/1967 | Lesher et al. | 4/628 |
| 3,451,068 | 6/1969 | Phillips | 4/628 |
| 3,639,920 | 2/1972 | Griffin et al. . | |
| 4,144,596 | 3/1979 | MacFarlane et al. . | |
| 4,145,769 | 3/1979 | MacFarlane et al. . | |
| 4,295,233 | 10/1981 | Hinkel et al. . | |
| 4,336,619 | 6/1982 | Hinkel et al. . | |
| 4,398,310 | 8/1983 | Lienhard . | |
| 4,606,085 | 8/1986 | Davies . | |
| 5,031,258 | 7/1991 | Shaw . | |
| 5,199,118 | 4/1993 | Cole et al. | 4/628 X |

FOREIGN PATENT DOCUMENTS

| | | | |
|---|---|---|---|
| 0396039 | 11/1990 | European Pat. Off. | 4/628 |
| 0125730 | 5/1991 | Japan | 4/628 |
| 4216727 | 8/1992 | Japan | 4/628 |

OTHER PUBLICATIONS

Leaflet, "Sensamatic" Wash Station by World Dryer, Berkeley, IL.

*Primary Examiner*—Charles E. Phillips
*Attorney, Agent, or Firm*—Leo Zucker

[57] ABSTRACT

Hand sanitizing apparatus for use in combination with existing wash basins having a water supply. A person's hands are washed and dried while held at a sensed position below the apparatus. The apparatus includes a housing adapted to be supported a given height above the wash basin, and a soap/water spray head fixed inside the housing to direct soap and water toward the person's hands. Hot and cold water lines extend between the wash basin water supply and a solenoid valve in the housing, to communicate warm rinse water from the valve when opened to the spray head of the apparatus. A soap reservoir and pump are arranged inside the housing to communicate liquified soap to the spray head. An air dryer unit fixed inside the housing serves to dry the hands after wetting by the soap and water sprays. An electrical control circuit includes a sensor that detects the presence of the hands at the sensed position, and a microcontroller for sequential activation of the soap pump, the water solenoid valve, and the air dryer unit over preset operating cycles.

17 Claims, 7 Drawing Sheets

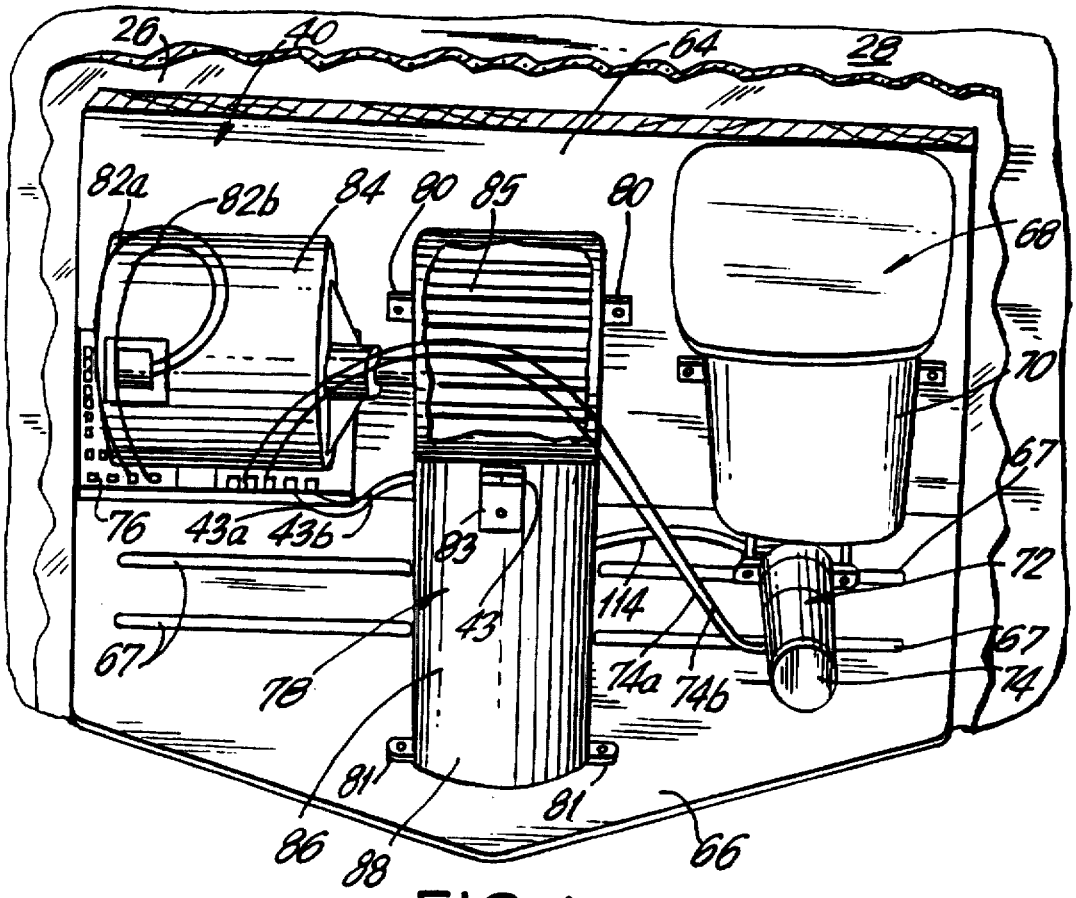
FIG.4
FIG.5
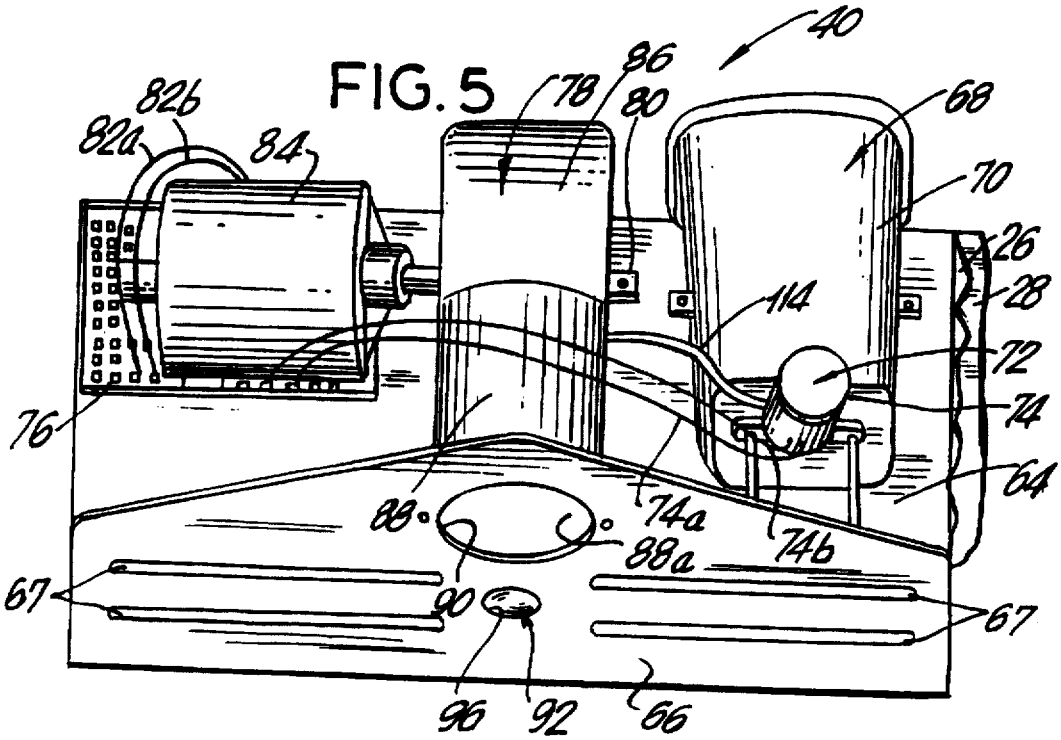

HAND SANITIZING APPARATUS

This is a continuation of Ser. No. 08/346,863 filed Nov. 30, 1994, now abandoned.

BACKGROUND OF THE INVENTION

1. Field of the Invention

The present invention relates generally to apparatus that facilitates the washing and drying of a person's hands. More particularly, it relates to economical hand sanitizing apparatus capable of thoroughly cleansing and drying a person's hands all while the hands are held at one position.

2. Description of the Known Art

Basic personal hygiene requires persons to clean and dry their hands many times over the course of the day. People wash their hands prior to preparing and eating meals, after performing manual tasks that tend to soil the hands, e.g., working with tools in or out of doors, household cleaning, servicing an automobile; and prior to leaving a bathroom or a public rest room. Further, in order to avoid bacterial contamination of food and ensuing illnesses by customers, persons working in the food service industry are obliged to wash their hands thoroughly before starting work, after handling money, after smoking or eating, and after cleaning tables, ovens or other appliances at the premises. Nonetheless, any hand sanitizing procedure that is time consuming and/or inconvenient will tend to be ignored by food service personnel and most persons generally.

Hand washing facilities provided in bathrooms, rest rooms and lavatories usually have a sink or wash basin, with a water outlet or faucet and separate, hand-operated hot and cold water faucet valves. Further, hand soap is supplied either as a solid bar or in liquid form from a dispenser mounted on a wall near the basin. Because of this, a person is required to activate the dispenser with soiled hands, then move the soap laden hands toward the basin to operate the water valves, and then scrub and rinse their hands under water from the faucet. After working up a soap lather and rinsing off the lather in the basin, the dripping wet hands are then brought to a remotely located hand towel or hot air dryer station.

In view of the above, hand washing in public rest rooms is an untidy exercise and actually tends to create, rather than alleviate, unsanitary conditions; for example, soiled or contaminated soap and towel dispensers, and dirty splash water accumulating on counter tops and floors. Further, the many different manipulations required of a person to operate faucets, soap dispensers and hand towel or dryer apparatus can be particularly onerous for the physically impaired, whose special needs in public facilities must be recognized under the Americans With Disabilities Act of 1990, Public Law 101-336.

A wash station supplied by World Dryer under the mark "Sensamatic", includes a special sink with a goose neck faucet and a box enclosure mounted on a cabinet extending from the rear of the sink. The box enclosure has a soap dispenser at one side, and an air dryer at the other side. Separate sensors at each side of the enclosure control various operations of the wash station as a person moves their hands under the different sensors.

U.S. Pat. No. 4,398,310 (Aug. 16, 1983) discloses a washstand device including a housing which forms a washing chamber or cavity. As is the case with the mentioned Sensamatic wash station, the patented washstand device is formed integrally with a washing chamber or sink. The known units thus are not arranged to cooperate with existing wash basins or sinks found in most rest rooms.

U.S. Pat. No. 1,765,915 (Jun. 24, 1930) discloses coin-operated apparatus for washing and drying hands, using several discharge passages. See also U.S. Pat. Nos. 2,504,740 (Apr. 18, 1950); 4,336,619 (Jun. 29, 1982); and 4,606,085 (Aug. 19, 1986).

SUMMARY OF THE INVENTION

An object of the invention is to provide hand sanitizing apparatus that will facilitate thorough and convenient cleansing and drying of a person's hands, including persons whose freedom of hand movement may be impaired due to a physical disability.

A further object of the invention is to provide compact hand sanitizing apparatus for installation in rest rooms with common wash basins or sinks, but which will obviate the need for separate soap and dryer or towel dispenser units.

Yet another object of the invention is to provide hand sanitizing apparatus capable of installation in food service establishments, to facilitate compliance with local health laws.

A further object of the invention is to provide hand sanitizing apparatus that will eliminate soap and water spillage on rest room counter tops and floors.

According to the invention, hand sanitizing apparatus for use in combination with a wash basin or sink having water supply means, to facilitate washing and drying of a person's hands when held at a sensed position over the basin, comprises a housing adapted to be supported a given height above a wash basin, and spray head means fixed in the housing for directing sprays of water and soap toward a person's hands at the sensed position over the wash basin. Water conduit means communicates water from water supply means associated with the wash basin, to the spray head means. Cleaning agent dispensing means fixed in the housing directs a hand cleanser through the spray head means toward the person's hands at the sensed position, and dryer means fixed with respect to the housing operates to propel heated air toward the hands at the sensed position. Control means serves to control operational cycles of the apparatus in response to certain input conditions. The control means includes means for detecting the presence of the hands at the sensed position, means for activating the cleaning agent dispensing means, means for opening the water conduit means, and means for energizing the dryer means over corresponding operating cycles of preset durations all while the hands remain at the same sensed position.

For a better understanding of the present invention, together with other and further objects, reference is made to the following description taken in conjunction with the accompanying drawing, and the scope of the invention will be pointed out in the appended claims.

BRIEF DESCRIPTION OF THE DRAWING

In the drawing:

FIG. 4 is a perspective, interior view of the present hand sanitizing apparatus as seen from above;

FIG. 5 is a view of the apparatus of FIG. 4 as seen from below;

DETAILED DESCRIPTION OF THE INVENTION

Figure 1:
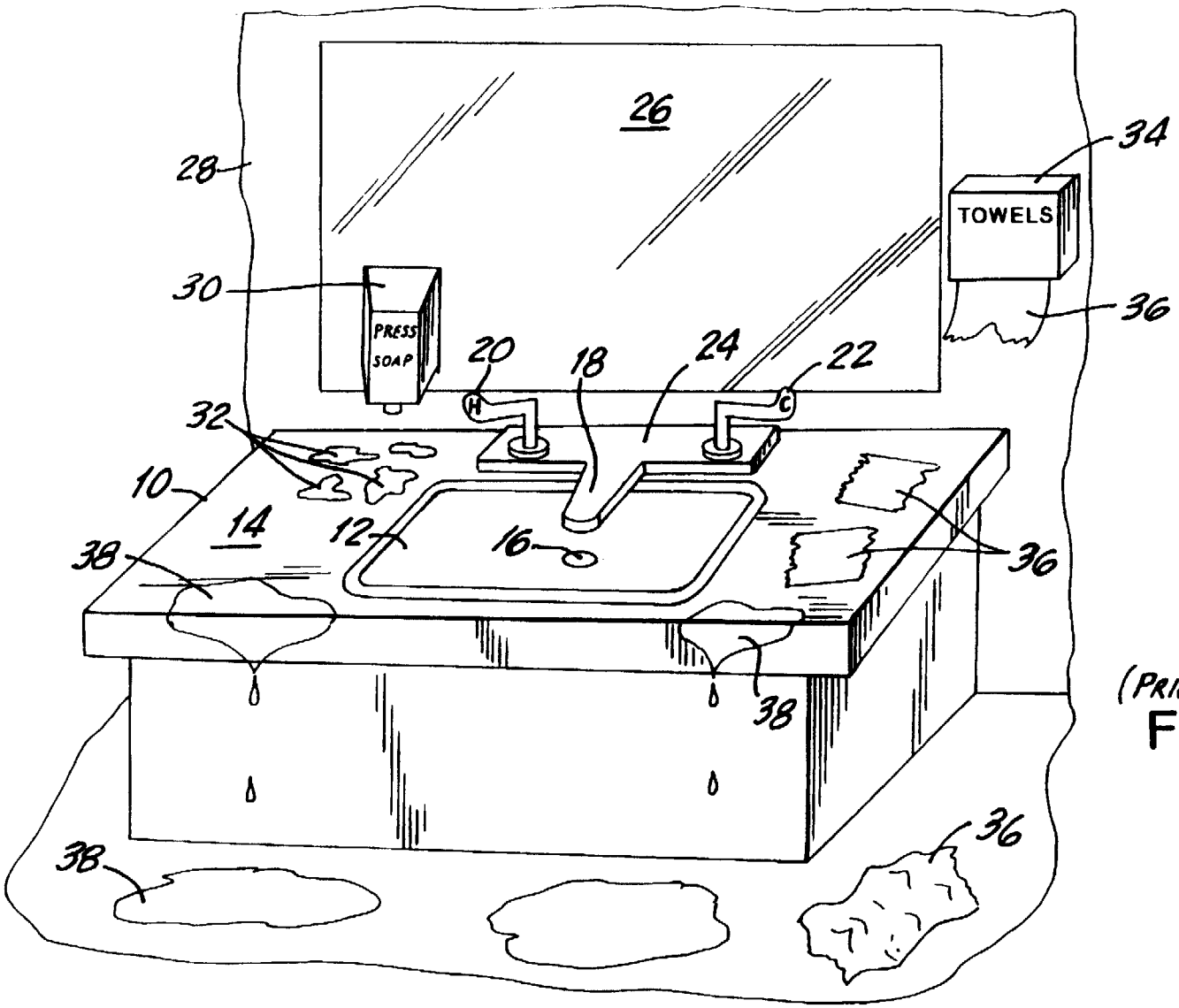
(PRIOR ART) FIG. 1
FIG. 1 is a perspective view of a conventional rest room wash basin area.

FIG. 1 is a perspective view of a present day restroom wash basin 10, including a metal or ceramic sink 12 seated within an opening in a sink counter top 14. The sink 12 has a drain 16 at a lowermost position, and a faucet spout 18 extending over the sink. Spout 18 directs hot and cold running water into the sink 12 in accordance with manual operation of a hot-water valve handle 20 and a cold-water valve handle 22.

The faucet spout 18, and the hot and cold water valve handles 20, 22, are often provided in the form of a single water faucet supply fixture 24 that is clamped or otherwise secured to the surface of the counter top 14 behind the sink 12. In the United States, convention dictates that the hot water valve handle 20 be located to the left of the spout 18, and the cold water valve handle 22 be at the right, as viewed from the front of the wash basin. Conventional sink counter tops have a set of three aligned one-inch diameter openings 46*a*, 46*b*, 46*c*(FIG. 9) spaced two inches on centers, behind the opening for the sink 12. The three openings (see FIG. 2) are intended to accept the passage of water control valve bodies and other parts of the fixture 24, to facilitate water tight mounting of the fixture 24 on the surface of the counter top 14.

A mirror 26 is mounted flush on a back wall 28 above the counter top 14. A dispenser 30 for holding liquified soap is secured on the surface of the mirror 26 a sufficient height above the top 14 to permit a person to cup one hand beneath the dispenser 30 to receive a measure of soap while pressing an actuator on the dispenser with the other hand. Frequently, puddles of liquified soap 32 accumulate on the counter top 14 beneath the dispenser 30. The soap puddles may originate from an outlet of the dispenser 30 after a person withdraws his or her hand from beneath the dispenser, or from drippings from the hands before the person returns their hands over the sink 12. Accumulation of the soap puddles 32 is unsightly and necessitates frequent wiping up by maintenance personnel.

A towel dispenser 34 is mounted on the back wall 28 adjacent the mirror 26. The dispenser 24 contains paper toweling 36 which may be in the form of a continuous roll or separate sheets stacked on one another. Alternatively, in place of the towel dispenser 34, an electric, warm air dryer may be provided. As shown in FIG. 1, the use of paper toweling invites scattering of torn, used towels 36 about the surface of the counter top 14, especially near the dispenser 34. As with the soap puddles 32, strewn fragments of used paper towels 36 create an untidy appearance as well as an unsanitary condition in which bacteria can quickly multiply.

Because some persons may open the hot and the cold water valve handles 20, 22 more than necessary, water splashes 38 are frequently seen about the sink top 14 and water will tend to accumulate on the floor below the front edge of the top 14.

Figure 2:
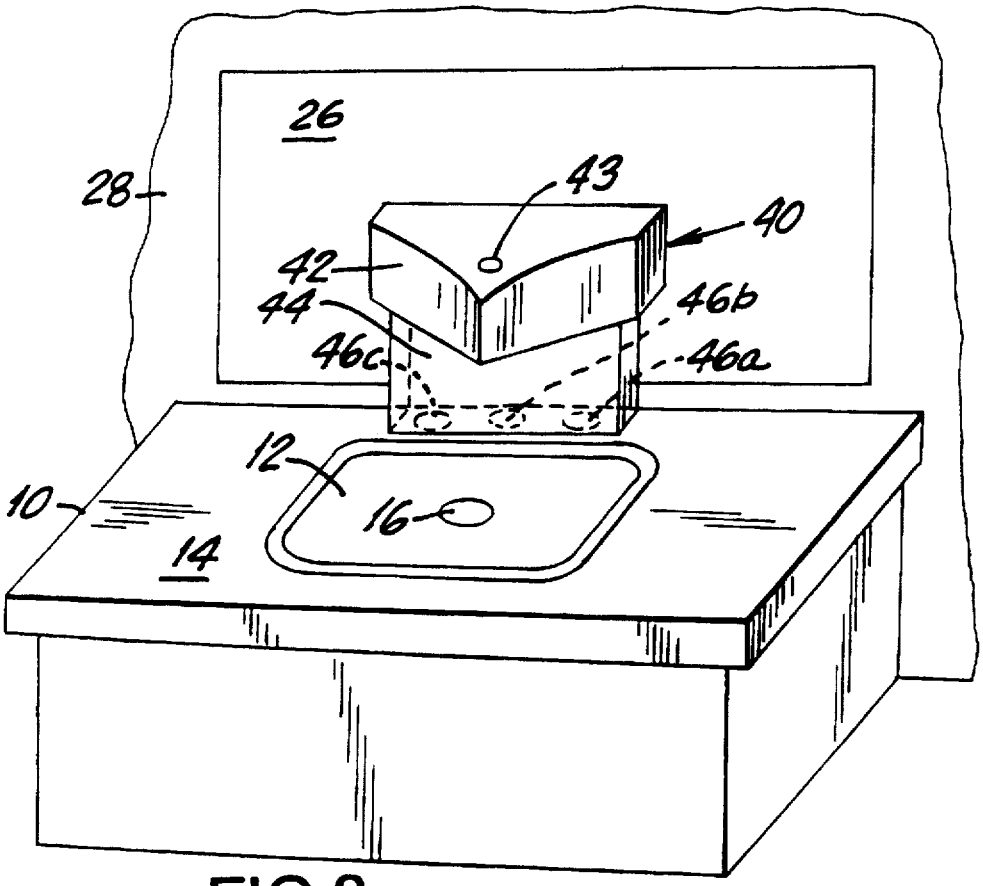
FIG. 2 is a perspective view of a restroom wash basin area according to the invention.

FIG. 2 is a perspective view of the restroom wash basin 10 in FIG. 1, with hand sanitizing apparatus 40 according to the invention. Note that the water supply faucet fixture 24 with faucet spout 18; the hot and the cold water valve handles 20, 22; the soap dispenser 30 and the towel dispenser 34 of the FIG. 1 arrangement, are no longer present. Also absent are the soap puddles 32, towel fragments 36 and water splashes 38 associated with the arrangement of FIG. 1.

As viewed when standing in front of the sink 12, the present apparatus 40 has an external, upper hood cover 42, and a lower shield 44. Both the hood cover and the lower shield are preferably formed from a rust proof metallic material such as, e.g., sheet stainless steel. A pilot lamp or LED 43 is mounted beneath and protrudes through an opening in the hood cover 42.

The lower shield 44 has a vertical front wall surface, the bottom edge of which rests on the sink top 14 just forward of three openings 46*a*, 46*b*, 46*c* in the sink top 14. The openings 46*a*, 46*b*, 46*c* have centers on a line extending parallel to the back wall 28. Further details of the hand sanitizing apparatus 40 and its installation with the wash basin 10, are set out below.

Figure 3:
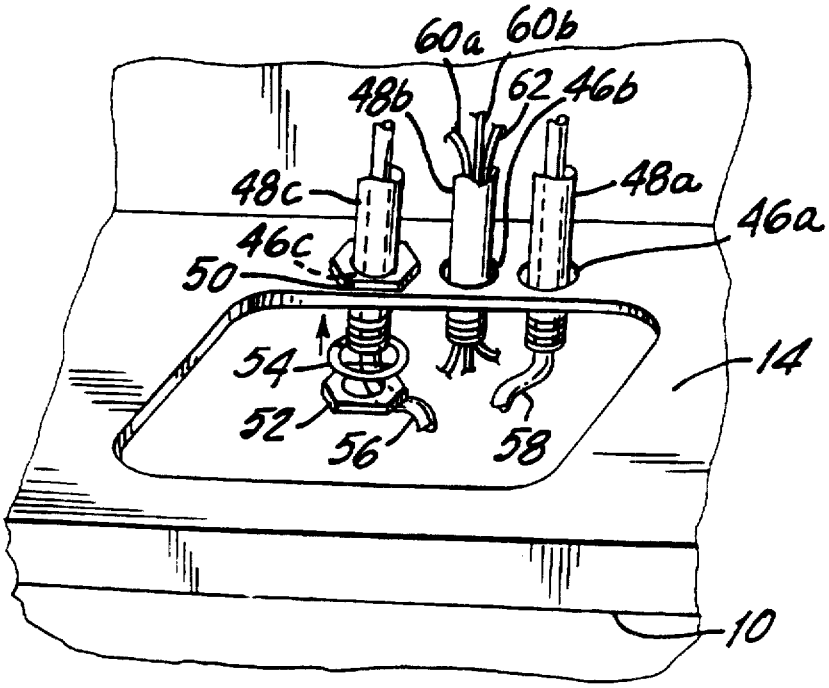
FIG. 3 is an enlarged perspective view of a portion of the wash basin area in FIG. 2 with some structure removed to show underlying parts.

FIG. 3 is a perspective view of a portion of the wash basin 10 in FIG. 2, with the sink 12 and the lower shield 44 of the apparatus 40 removed to show underlying parts.

Three pipe sections 48*a*, 48*b*, 48*c* extend vertically through corresponding ones of the openings 46*a*, 46*b*, 46*c* in the sink top 14. The pipe sections have external threads at their lower ends. Each of the pipe sections is firmly attached to the sink top 14 by way of, for example, a pair of lock nuts 50, 52, and one or more washers 54 at the lower end of each pipe section. once the faucet fixture 24 in FIG. 1 is withdrawn from the sink top 14, hot and cold water supply lines 56, 58 that would otherwise connect to the fixture 24, are instead routed through pipe sections 48*c*, 48*a*, respectively, as shown in FIG. 3. Also, a pair of insulated conductors or leads 60*a*, 60*b* and a ground wire 62 are routed through the center pipe section 48*b*. The conductors 60*a*, 60*b* are connected beneath the sink top 14 to the AC mains, and the ground wire 62 may be connected to a cold water pipe or other electric service ground point as specified by the applicable electric codes.

FIG. 4 is a perspective view of the present apparatus 40 as seen from above, and with the upper hood cover 42 removed. FIG. 5 is a perspective view of the uncovered apparatus 40 as seen from below.

A wooden mounting board 64 forms a back wall of the apparatus, to enable the apparatus to be secured with suitable fastening members (not shown) to the back wall 28 of the restroom in FIG. 2, with the wall mirror 26 sandwiched between the mounting board 64 and the wall 28. A generally triangular lower base plate 66 projects from the mounting board 64, so that a forward apex portion of the base plate 66 extends over the sink drain 16 when the apparatus 40 is mounted in place. Air intake louvers or slots 67 are cut in the plate 66, in a direction parallel to the surface of the mounting board 64.

The apparatus 40 also includes a soap dispenser 68, including a soap reservoir tank 70 and a soap pump 72 having an inlet in communication with the bottom of the tank 70, and an outlet soap supply line 114. The soap pump 72 includes a motor 74 energized via a pair of electrical conductors or leads 74*a*, 74*b*. The soap pump leads 74*a*, 74*b* are routed toward the left side of the base plate 66 as viewed in FIG. 4, to connect with terminals on an electronic timer control board 76. The control board 76 is mounted on suitable brackets parallel to the inside surface of the mounting board 64.

An air blower/motor unit 78 such as Type NSE-12 manufactured by Bodine Electric Co. comprises a motor 84 having a shaft coupled to a "squirrel cage" fan rotor 85 of a centrifugal blower 86. Blower 86 has a molded casing in which an internal air heater coil is supported in the region of blower outlet 88. The blower casing has a set of mounting lugs 80 by which the unit 78 is fixed to the mounting board 64. A pair of insulated wire conductors 82*b*, 82*b* are connected between terminals on the control board 76 and the motor 84. A bracket 83 fixed to the blower casing holds the pilot LED 43.

Blower outlet 88 has its open end 88*a* in registration with an opening 90 formed in the apex portion of the lower base plate 66. See FIG. 5. Another set of mounting lugs 81 are provided on the circumference of the outlet 88 to fix the outlet in position on the base plate 66. The blower outlet has about a 3-inch inside diameter over its entire length.

A reflective mode light sensor 92 (see FIG. 6A) is mounted on a bracket 94 behind the outlet 88 of the blower unit 86. Light sensor 92 is aimed through an opening 96 in the base plate 66, so as to detect the presence of a person's hands when brought to a sensing position, e.g., about 8 inches below the open end 88*a* of the blower outlet 88. A set of wire leads 98 connects the sensor 92 with terminals on the timer control board 76. Light sensor 92 may be device type CY-22 supplied by Sunx Trading Company, Ltd., Tokyo, Japan.

Figure 6A:
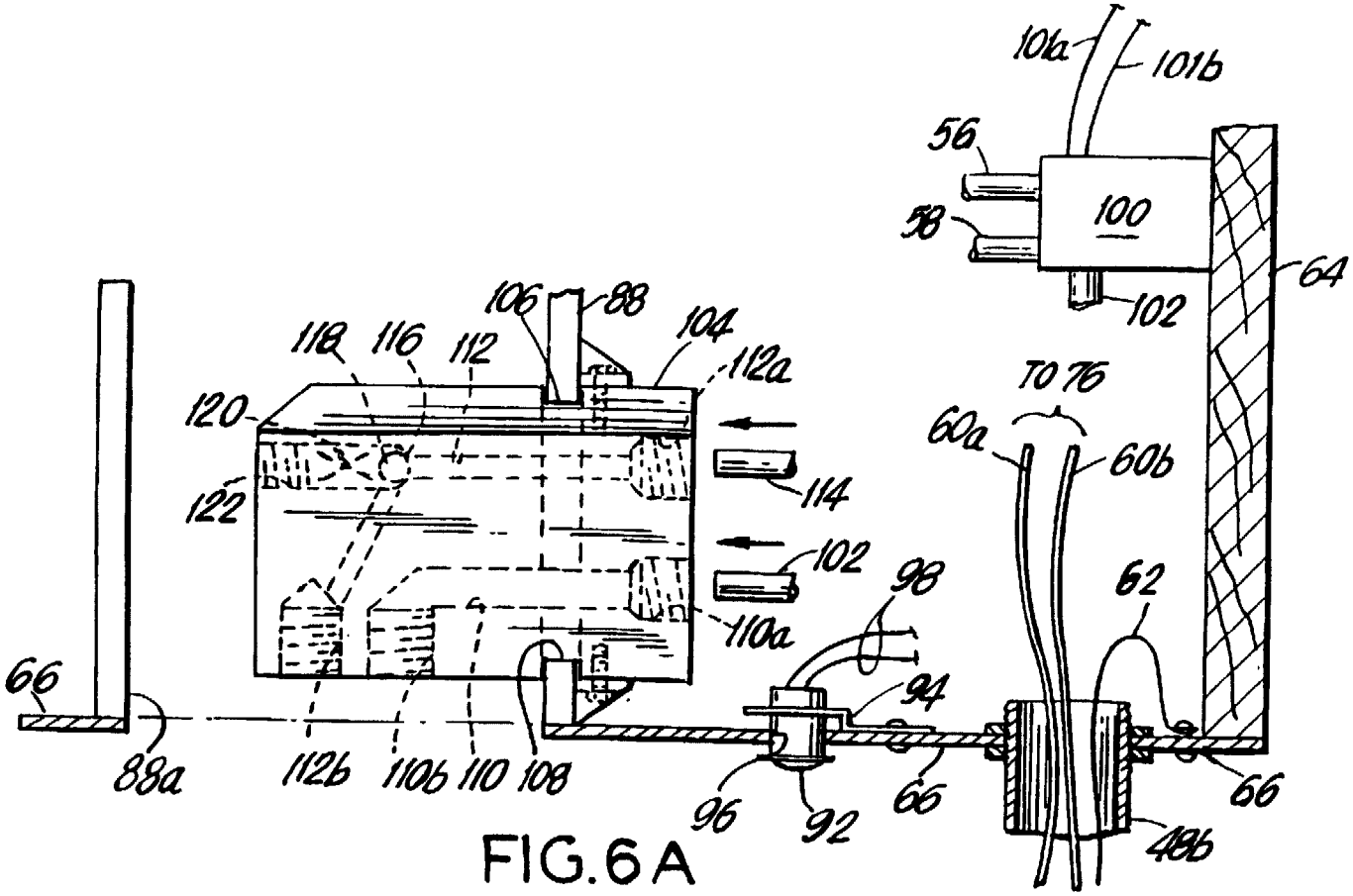
FIG. 6A is an enlarged, cross-sectional view of the present apparatus taken along line 6A—6A in FIG. 4.

The pipe sections 48*a*, 48*b*, 48*c* (FIG. 3) each have threaded upper end portions that pass through corresponding openings in the lower base plate 66 of the apparatus 40, and are fixed to the plate 66 via lock nuts and washers. FIG. 6A shows the upper end of pipe section 48*b*. The wire leads 60*a*, 60*b* routed through the pipe section 48*b* are connected to terminals on the timer control board 76, and the ground wire 62 is connected to a suitable ground point on the base plate 66 and/or the control board 76. The hot water supply line 56 running up pipe section 48*c*, and the cold water supply line 58 that runs in pipe section 48*a*, are fitted at their upper ends to a dual inlet water solenoid valve 100.

When the water solenoid valve 100 is energized via wire leads 101*a*, 101*b* extending between the valve 100 and the control board 76, water from both supply lines 56, 58 mixes together and is directed through a rinse water supply line 102 to a soap and water spray head 104. The spray head 104 is supported inside the outlet 88 of the blower 86, just above the open end 88*a* of the casing outlet.

Figure 6B:
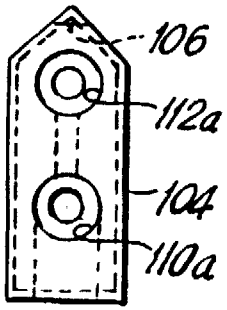
FIG. 6B is an end view of liquid spray head means shown in FIG. 6A.

FIG. 6A shows the soap and water spray head 104 fixed inside the blower outlet 88, according to the invention. FIG. 6B is an end view of the spray head 104 as seen from the right in FIG. 6A.

The spray head 104 is machined from stainless steel stock and as shown in the drawing, has a body of generally rectangular solid form. Spray head 104 has a groove 106 cut in its periphery, in a plane perpendicular to the long axis of the spray head 104. Groove 106 receives the edges of a cut-out 108 in the blower casing. For example, if the blower casing is formed from two symmetrical half casings each having one-half of the cut-out 108, the spray head 104 may be seated in place as the casing halves are joined and the cut-out 108 is defined. Spray head 104 may be secured further to the blower outlet 88 by fastening screws passing through lugs formed on the casing periphery, to ensure steady mounting of the head 104 relative to the base plate 66.

A rinse water passage 110 is formed in the spray head 104, with an inlet port 110*a* at the right end of the spray head as viewed in FIG. 6A. A discharge port 110*b* on a bottom side of the head opens downwardly in the direction of the open end 88*a* of the blower outlet 88. Rinse water passage 110 has internal threads cut at each port to accept a standard pipe thread, e.g., ⅛-inch diameter. The downstream end of the rinse water supply line 102 is coupled to the inlet port 110*a* by, for example, a standard compression nut (not shown) to insure a leak-proof connection.

A second passage 112 extends through the spray head 104 between a soap inlet port 112*a* and an outlet port 112*b*. Outlet port 112*b* also opens downwardly in the direction of the blower outlet open end 88*a*. A soap supply line 114 having one end connected to an outlet of the soap pump 72, has its downstream end connected to the soap inlet port 112*a* on the spray head 104 via a threaded compression nut or equivalent means (not shown).

One section of the second passage 112 extends from the inlet port 112*a* to a ball valve seat 116. Another section of the passage 112 communicates between the valve seat 116 and the soap outlet port 112*b*. A valve ball 118 is urged against the valve seat 116 by a pressure level adjust spring 120. The spring 120 is contained in a threaded bore 122 in the spray head 104, and is biased toward the ball 118 by a pressure level adjust screw 121. Accordingly, the ball 118 will prevent seepage of liquified soap from the soap outlet port 112b while the soap pump 72 is not activated, i.e., and when the delivery pressure within the soap supply line 114 is below a preset value needed to urge the valve ball 118 against the bias of the spring 120.

Figure 7:
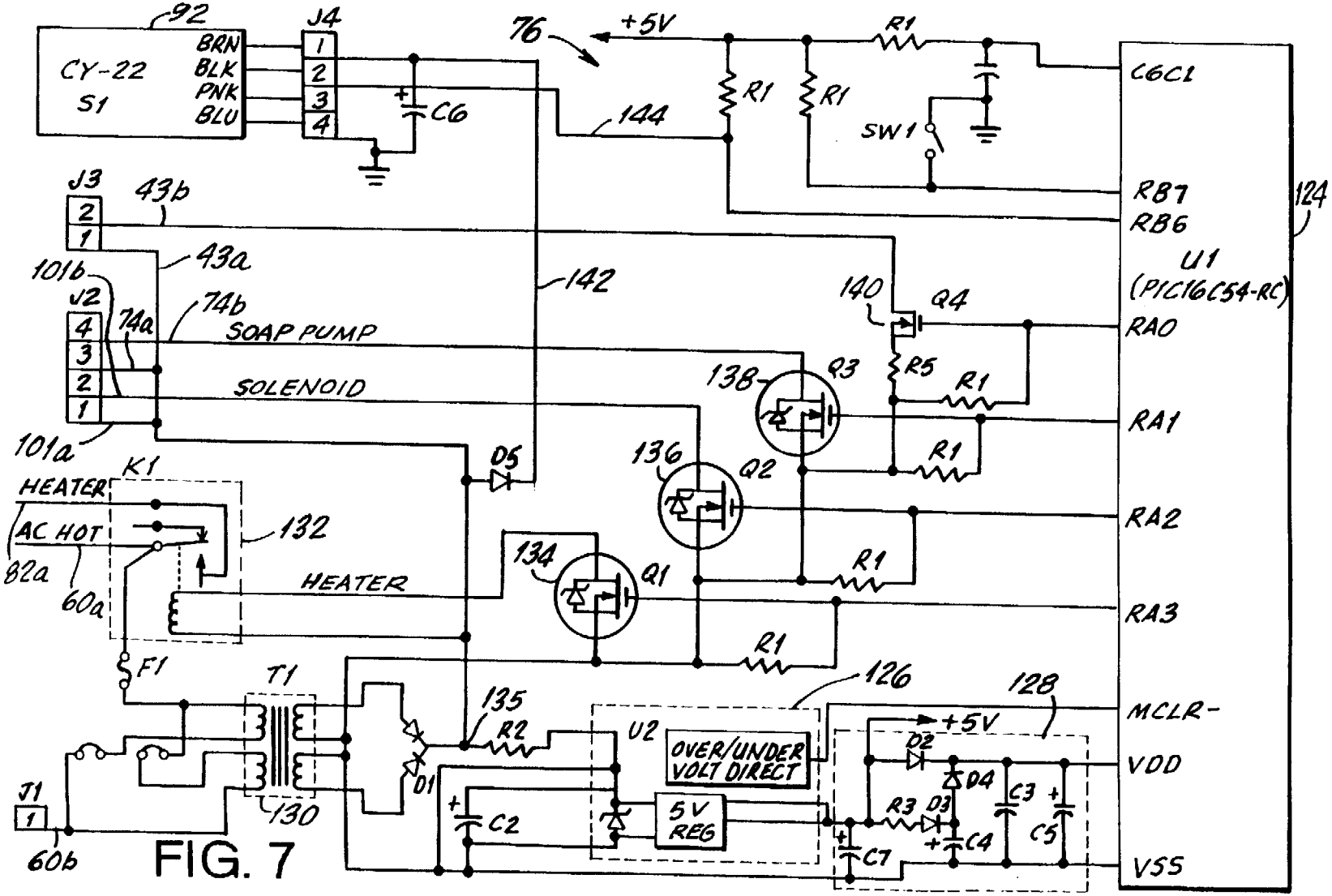
FIG. 7 is an electrical schematic diagram of control circuitry for the present apparatus.

FIG. 7 is a schematic diagram of electrical components mounted on the timer control board 76, and shows connections between the board and other parts of the present apparatus 40.

In the illustrated embodiment, operations of working components of the present apparatus 40, and the order or sequence of those operations, are brought under the control of a micro-controller 124 (U1). It has been found that a type PIC16C54A-RC EPROM based, 8-bit CMOS microcontroller available from Microchip Technology Inc., works satisfactorily to operate the present hand sanitizing apparatus. Detailed information concerning the configuration, programming, and operation of the type PIC16C54A microcontroller can be found in publication DES30207A from Microchip Technology, Inc. (1993). All relevant portions of the publication are incorporated herein by reference.

A 5-volt DC supply voltage is provided for the microcontroller 124 between pins Vdd (pin 14) and Vss (pin 5). The DC supply voltage is regulated by a voltage regulator integrated circuit 126 (U2). The DC output of the regulator IC 126 is filtered via a network 128 of discrete components identified in FIG. 7.

Conductors 60*a*, 60*b* which connect with the AC mains and enter the apparatus 40 through the pipe section 48*b* (FIG. 3), connect with the control board 76 at corresponding AC Hot and AC Neutral terminals shown at the left of FIG. 7. The neutral line 60*b* is connected to one side of each of two primary windings of a power transformer 130 (T1). The hot line 60a is connected through a fuse (F1) to the other sides of the primary windings of transformer 130. The dual primary windings of the transformer T1 allow it to be used with either 120 or 240 VAC mains. The illustrated embodiment is wired for a 120 VAC mains supply, but 240 VAC mains can be accommodated by connecting the primary windings of transformer 130 in series, and connecting the Neutral and Hot AC lines to opposite ends of the connected primary windings.

Transformer 130 has two 6-volt AC secondary windings connected in series to produce a 12 VAC, center-tapped supply output. The 12 VAC transformer output is full-wave rectified and applied through a 68 ohm resistor (R2) to an input terminal of the regulator 126.

A relay 132 (K1) operates to switch the AC Hot line 60*a* to the blower/motor unit 78, when energized by operation of the microcontroller 124 and an associated switching FET 134 (Q1). In the present embodiment, relay 132 has a 30 amp rating. The normally open (N0) terminal of the relay 132 connects with the wire conductor 82*a* of the blower/motor unit 78. Conductor 82*b* of the blower/motor unit 78 is connected to conductor 60*b*, i.e., the Neutral line of the AC mains. Conductor 60*a*, i.e., the Hot line of the AC mains, is connected to the common terminal (COM) of the blower/motor unit relay 132. The winding of the relay 132 is connected between the source of FET 134 and an unregulated DC output terminal 135 associated with the power supply. The switching FET 134 has its gate terminal connected to a control output terminal (RA3) of the microcontroller 124, and the drain of FET 134 is grounded.

A second switching FET 136 (Q2) has its gate terminal connected to another control terminal (RA2) of the microcontroller 124. The drain terminal of FET 136 is also grounded. The source terminal of FET 136 is connected to an operating coil lead 101*b* of the water solenoid valve 100. The remaining operating lead 101*a* of the water solenoid valve is connected to the unregulated DC output terminal 135 of the power supply.

A third switching FET 138 (Q3) has its gate terminal connected to a third control output terminal (RA1) of the microcontroller 124, and the drain terminal of FET 138 is also grounded. Conductor 74*b* associated with the soap pump 72, is connected to the source terminal of FET 138, and the remaining soap pump conductor 74*a* is connected to unregulated DC output terminal 135 of the power supply. Each of the three FETs 134, 136 and 138 may be device type MTP3055EL. A base resistor (R1—47K) is connected between the gate and drain terminals of each of the switching FETs.

A fourth switching FET 140 (Q4) has its gate terminal connected to a fourth control output terminal (RA0) of the microcontroller 124, and its drain terminal is also grounded. Lead 43*b* of the operating pilot LED 43 (FIG. 2) is connected to the source terminal of the FET 140, and the remaining pilot LED lead 43*a* connects to the unregulated DC voltage terminal 135. FET 140 may be device type BS170.

The reflective mode light sensor 92 is powered through lead 142, which connects the sensor through a diode to the supply terminal 135. The ground terminal (BLU) of the sensor 92 is connected to power supply ground and a smoothing capacitor (220 uF) is connected across the supply terminals (BRN–BLU) of the sensor 92. An output terminal (BLK) of the sensor is connected via conductor 144 to a control input terminal (RB6) of microcontroller 124. Control input terminal RB6 also connects to the regulated 5 VDC power supply output through a 47K resistor.

The clock frequency of microcontroller 124 is determined by a RC network connected between terminal OSC1 of the device, and ground. Microcontroller 124 is set to an ON condition by grounding terminal RB7 via a switch SW1. Terminal RB7 is tied to the 5 VDC supply through a 47K resistor, when switch SW1 is open.

Operation of the present hand sanitizing apparatus 40 will now be described. Programming of the microcontroller 124 can be carried out by a person skilled in the art, and with reference to the mentioned publication of Microchip Technology Inc. Other timing circuits may also be employed with or without the use of a microcontroller IC, and all such equivalent circuit variations are intended to be included within and to form a part of the present invention.

Figure 8:
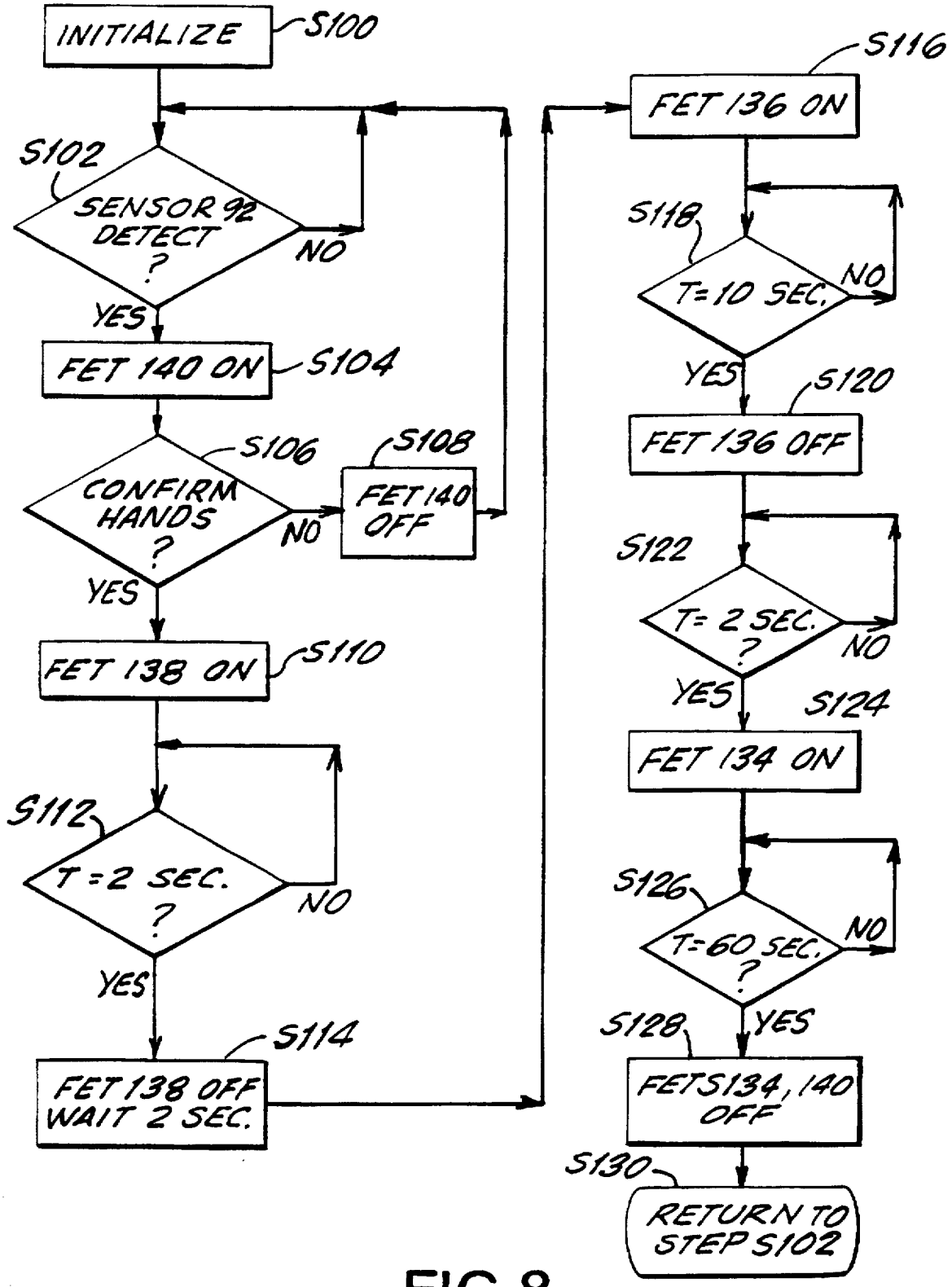
FIG. 8 is a flow diagram of sequential wash cycles controlled by the circuitry of FIG. 7.

FIG. 8 is a flow diagram of a typical wash cycle operating program that can be pre-stored in microcontroller 124. The microcontroller 124 performs an initialization step S100 upon closure of switch SW1.

When a person approaches the sink counter top 14 in FIG. 2, he or she places the hands beneath their apparatus hood cover 42 within about 8 inches of the detecting face of the light sensor 92. Detection of the hands is signaled (step S102) by the sensor 92 over conductor 144 (FIG. 7) to the microcontroller 124. Upon detection of the hands, FET 140 is switched on (step S104) and the operating pilot LED 43 is lit. The presence of the hands is confirmed over a period of about one second (step S106).

Upon confirmation, FET 138 is switched on (S110) to energize the soap pump 72. Liquified soap is then dispensed from the pump 72 through the supply line 114 and into the passage 112 of the soap/water spray head 104 (see FIG. 6A). The check valve ball 118 is then urged to the left in FIG. 6A, and soap is pumped under pressure to exit from the soap outlet port 112*b* onto the person's hands. Soap pumping continues for about two seconds (S112), followed by a two second wait (S114).

FET 136 is then switched on by the microcontroller 124 (S116), to open the water solenoid valve 100. Hot and cold water from the supply lines 56, 58 is then mixed and discharged under pressure through the rinse water supply line 102, into the rinse water passage 110 of the soap/water spray head 104. Warm rinse water then exits from the discharge port 110*b* of the head 104 onto the person's hands.

Although both the soap and the rinse water outlet ports 112*b*, 110*b* in FIG. 6A are shown without nozzles or other liquid restricting devices, such devices may be threaded into one or both of the outlet ports 110*b*, 112*b* to enhance the delivery of soap and rinse water onto the hands, as well as for conservation purposes. As long as the hands are detected, the water solenoid valve 100 is energized for up to 10 seconds (S118).

If, during the rinse water discharge cycle the hands are no longer detected for five or more seconds, the rinse water cycle is terminated but the pilot LED 43 remains on. This indicates that if the hands are re-detected the rinse water cycle will resume from the time at which it was terminated. That is, the pilot LED 43 remains on for five seconds if the hands are not detected during the rinse water cycle. Once the LED 43 extinguishes, detection of the hands by the sensor 92 will cause a new cycle to begin with activation of the soap pump 72 via the switching FET 138.

When the water solenoid valve 100 closes after a ten-second total open period (S120), microcontroller 104 allows another two-second pause (Sl22), and FET 134 is switched on (S124) to close the blower/motor relay 132. As long as the hands are detected by the sensor 92, relay 132 remains closed to energize the blower/motor unit 78, and heated air is discharged down through the open end 88*a* of the blower outlet 88, through the opening 90 in the apparatus base plate 66 and onto the person's hands. If uninterrupted, the hand drying cycle continues about 60 seconds (S126). If, however, the hands are withdrawn prior to the lapse of 60 seconds, the hand drying cycle terminates but will continue to run if the hands are re-detected within five seconds from the time they were no longer detected by the sensor 92.

The pilot LED 43 extinguishes whenever a wash cycle terminates (S128). Also, upon completion of a drying cycle (60 seconds total), additional 10-second drying cycles will be executed if the hands remain detected. If the hands are not detected for up to five seconds, the program returns to step S102 and the soap pump 72 will be activated upon detection of the hands beneath the sensor 92.

In summary, as long as the hands are detected by the sensor 92, the present apparatus 40 continues through sequential soap, rinse water, and drying operating cycles. In addition, if the rinse water or hand drying cycles terminate prematurely because of non-detection of the hands, an immediate detection of the hands will cause the rinse or dry cycle to continue from the time at which it was stopped.

An alternative hand washing/drying program for the apparatus 40 can provide an initial "pre-rinse" cycle before the dispensing of the soap. Again, the manner in which such a pre-rinse cycle can be implemented would be apparent to one skilled in the art, either by way of programming of microcontroller 124 or other equivalent means.

The following table sets out typical programmable wash cycles for the apparatus 40, other than the example set forth above. For each selectable program, the operation cycle sequence and the time for each operation, may all be prestored in the microcontroller 124 and the desired program may be selected by way of a suitable input device such as a DIP switch or a keypad located inside the hood cover 42.

TABLE 1

Typical Programmable Wash Cycles

| WASH CATEGORY | PROGRAM SELECT NO. | OPERATION SEQUENCE—TIME |
|---|---|---|
| Fast Wash | 1 | Rinse water — 2 secs.<br>Air Dry — 30 secs. |
| Fast Wash | 2 | Soap — 1 sec.<br>Rinse water — 10 secs.<br>Air Dry — 90 secs. |
| Fast Wash | 3 | Rinse water — 1 sec.<br>Soap — 1 sec.<br>Rinse water — 10 secs.<br>Air Dry — 90 secs. |
| Good Wash | 4 | Soap — 1 sec.<br>Delay — 2 secs.<br>Rinse water — 10 secs.<br>Delay — 2 secs.<br>Air Dry — 90 secs. |
| Good Wash | 5 | Rinse water — 1 sec.<br>Soap — 1 sec.<br>Delay — 2 secs.<br>Rinse water — 15 secs.<br>Delay — 2 secs.<br>Air Dry — 90 secs. |
| Good Wash | 6 | Rinse water — 1 sec.<br>Soap — 1 sec.<br>Delay — 4 secs.<br>Rinse water — 15 secs.<br>Delay — 2 secs.<br>Air Dry — 90 secs. |
| Thorough Wash | 7 | Rinse water — 2 secs.<br>Soap — 2 secs.<br>Delay — 4 secs.<br>Rinse water — 20 secs.<br>Delay — 3 secs. |

TABLE 1-continued

Typical Programmable Wash Cycles

| WASH CATEGORY | PROGRAM SELECT NO. | OPERATION SEQUENCE—TIME |
|---|---|---|
| | | Air Dry — 90 secs. |
| Thorough Wash | 8 | Rinse water — 1 sec.<br>Soap — 1 sec.<br>Delay — 3 secs.<br>Rinse water — 10 secs.<br>Soap — 1 sec.<br>Delay — 3 secs.<br>Rinse water — 15 secs.<br>Air Dry — 90 secs. |
| Thorough Wash | 9 | Rinse water — 1 sec.<br>Soap — 2 secs.<br>Delay — 4 secs.<br>Rinse water — 20 secs.<br>Delay — 2 secs.<br>Air Dry — 90 secs. |

A three-digit LED numeric display also may be contained in the apparatus 40 for purposes of maintaining a running count of the number of times the apparatus 40 is operated. Preferably, the counter records the number of soap pump activations to reflect most accurately the number of times the apparatus 40 is used for a single hand washing/drying event. Use of the counter would enable commercial establishments, for example, to determine how often the apparatus 40 is being used in a restroom by customers or employees, and to determine user preferences when the apparatus 40 is placed in a restroom where conventional sink basins with faucets, soap dispensers and hand towels are also available.

In a preferred embodiment, if the level of soap in the reservoir tank 70 falls below a sensed fill height, the microcontroller 124 can be configured and programmed to signal a "low soap alarm" by, e.g., flashing the pilot LED on every five seconds to alert maintenance personnel that the soap reservoir tank 70 needs to be refilled.

Further, it may be desirable to provide jump switches across the FETs 134, 136, 138, to enable a manual check on the operation of the water and soap solenoids, and the blower/motor unit in case of a system malfunction.

The overall configuration of the present hand sanitizing apparatus 40 is very compact and lends itself to easy installation in existing restrooms having wash basins or sinks. The apparatus 40 is also capable of ready installation in wash rooms of food service establishments, to facilitate compliance with local health laws. Importantly, persons whose freedom of hand movement is impaired because of a physical disability, will find that the present apparatus facilitates what might otherwise be a burdensome task and encourages them to maintain personal cleanliness.

Typical dimensions for the upper hood cover 42 of the apparatus measure, for example, 15 inches wide by 11 inches high by 9 inches maximum depth. The apparatus 40 may be mounted directly at its back wall (mounting board 64) on the wall 28 of the restroom, or, alternatively, the apparatus 40 may be supported above the sink 12 via support arms and/or legs secured to the restroom wall or to the sink counter top 14.

The present hand sanitizing apparatus is versatile since it can be adapted to any one of a number of different positions relative to a bathroom sink or wash basin, various water and soap delivery restricting devices (e.g., spray nozzles) can be fitted on the discharge ports 110*b*, 112*b* of the spray head 104, and the microprocessor circuit configuration disclosed herein allows the owner or operator of the apparatus 40 to select one of a number of different wash cycles depending on the application to be met, for example, restaurant/food service restrooms, factories, office buildings and the like.

Through the use of accurately timed cycles for dispensing of soap and rinse water, and with the use of spray nozzles on the discharge ports, a good hand wash operation may consume no more that eight ounces of water and will avoid wasting of soap liquid over a long period of time. Accordingly, the present apparatus conserves resources and is well suited to locations at which waste water is drained to septic tanks as well as those areas in which water supplies may be limited. Even if no hot or cold water lines are present, a separate water tank and pump arrangement may be substituted, or water may be supplied directly by gravity from a reservoir tank situated above the apparatus 40.

Figure 9:
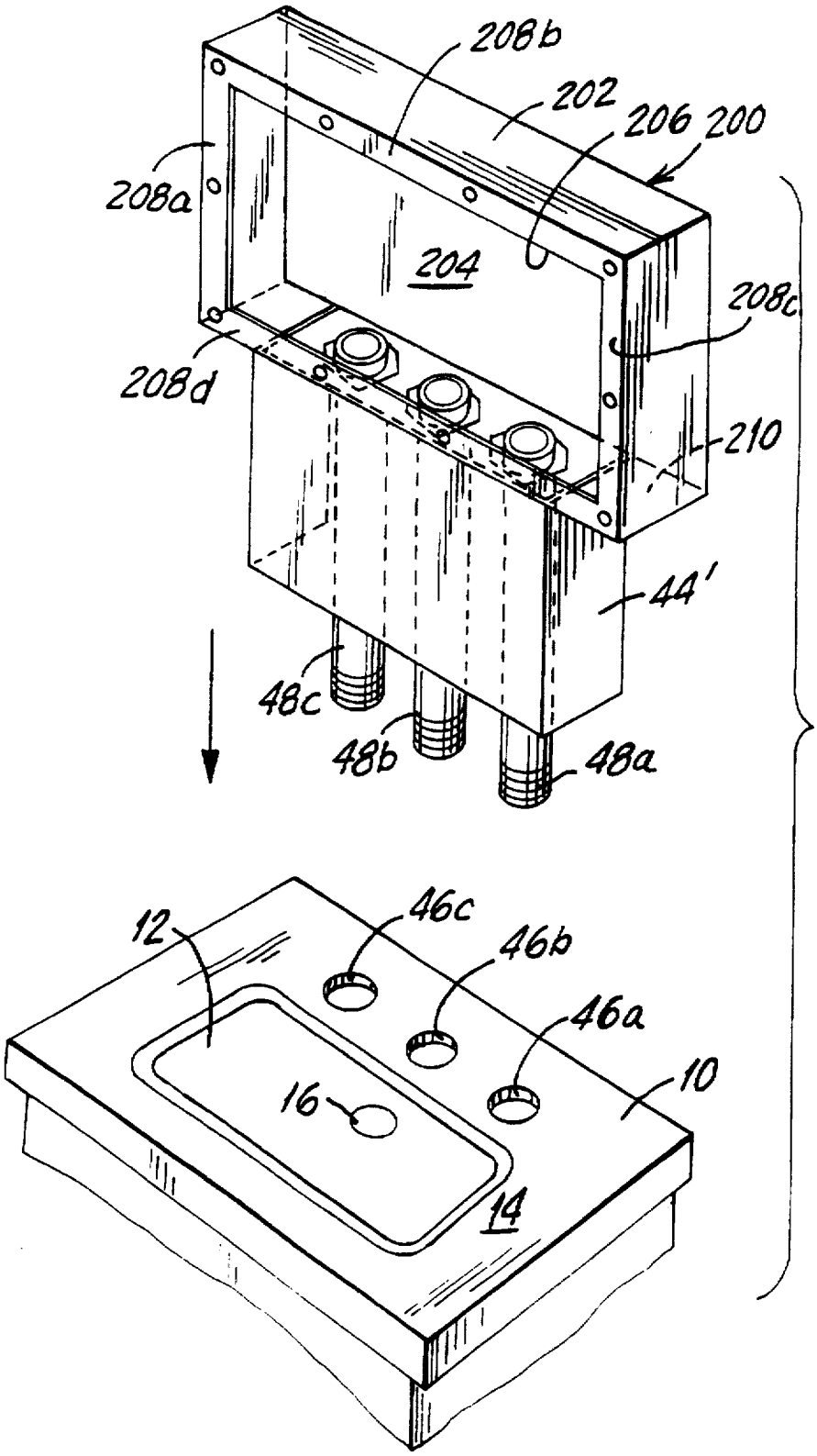
FIG. 9 is a perspective view of a support box assembly that facilitates installation and mounting of the present apparatus above an existing sink counter top.

FIG. 9 shows a support box assembly 200 on which the present apparatus may be mounted, once the assembly 200 is fixed to rest on the sink counter top 14. A generally rectangular, 16 gauge stainless steel mounting box 202 has a back panel 204, and a front opening 206. The opening 206 is framed by mounting flanges 208*a–d*. The flanges 208*a–d* have a series of regularly spaced openings for receiving corresponding fastening members (not shown) extending from the back of the mounting board 64 of the apparatus 40. That is, rather than securing the apparatus 40 directly with fasteners in the rest room wall 28 as in FIG. 4, the support box assembly 200 is positioned to rest on the counter top 14 with the back panel 204 facing the rest room wall, and the apparatus 40 is then mounted over the front opening 206 of the box 202, as explained below.

A lower shield 44' having a generally U-shaped cross-section is welded or otherwise fixed along its upper edges to a bottom side panel 210 of the box 202. The rear edges of the side walls of the shield 44' lie in a plane parallel to the plane of the back panel 204. The bottom side panel 210 has a set of three openings for receiving threaded upper ends of the pipe sections 48*a–c*, and the pipe sections are fixed at the upper ends to the panel 210 with, e.g., lock nuts and washers.

With the pipe sections 48*a–c* projecting below the lower edges of the shield 44', the support box assembly 200 is lowered toward the sink counter top 14 and the threaded lower ends of the pipe sections 48*a–c* are guided through corresponding openings 46*a–c* in the counter top 14 (see FIG. 3), until the lower edges of the shield 44' abut the counter top 14. Each of the pipe sections is then fixed to the counter top with, e.g., lock nuts and washers as shown in FIG. 3. The hot and cold water supply lines 56, 58 and the electrical service conductors 60*a*, 60*b* and 62, are all routed through corresponding pipe sections and emerge from the upper ends of the pipe sections inside the mounting box 202. The water supply lines and electrical conductors are directed through openings (not shown) in the apparatus mounting board 64 to connect with parts of the apparatus 40, and the apparatus is then fixed on the flanges 208*a–d* of the mounting box 202.

While the foregoing description represents a preferred embodiment of the invention, it will be obvious to those skilled in the are that various changes and modifications may be made, without departing from the true spirit and scope of the invention. Accordingly, the scope of the invention shall be interpreted and construed in accordance with the following claims.

What I claim is:

1. Hand sanitizing apparatus for use in combination with an existing wash basin sink, comprising:

mounting base means for mounting components of the apparatus adjacent a back wall of an existing wash basin sink and at a certain height above the sink;

cover means fixed to said mounting base means, for enclosing components mounted on said mounting base means;

spray head means mounted on said mounting base means for directing sprays of water and a hand soap toward a person's hands when held at a sensed position beneath said mounting base means;

water conduit means for diverting water supplied by an outside water supply for the existing sink, to the spray head means mounted on said mounting base means;

cleaning agent dispensing means mounted on said mounting base means, including soap reservoir tank means for containing a supply of said hand soap, and means for directing said soap through the spray head means toward the sensed position beneath said mounting base means;

dryer means mounted on said mounting base means, including means for heating air drawn inside said cover means, and means for propelling the heated air toward the person's hands at the sensed position beneath said mounting base means; and control means for controlling operational cycles of the apparatus in response to certain input conditions, the control means including means for detecting the presence of said hands at the sensed position beneath said mounting base means, and means for sequentially activating said cleaning agent dispensing means, said water conduit means, and said dryer means over corresponding operating cycles of preset durations while said hands remain at the sensed position beneath said mounting base means;

wherein said spray head means comprises a spray head body having a first passage with an inlet arranged to receive rinse water originating from said water conduit means and an outlet arranged to direct the rinse water toward the sensed position beneath said mounting base means, and a second passage with an inlet arranged to receive a hand soap originating from the cleaning agent dispensing means and an outlet arranged to direct the hand soap toward said sensed position; and said spray head body has a control valve passage in communication with said second passage, and means in said control valve passage for preventing seepage of said hand cleanser from the outlet of the second passage in the absence of a preset delivery pressure of the hand cleanser.

2. Hand sanitizing apparatus according to claim 1, wherein said control valve passage includes a valve seat, and said preventing means includes a valve ball and a spring member for biasing the valve ball on the valve seat.

3. Hand sanitizing apparatus, comprising:

a mounting wall constructed and arranged to be secured to a rest room wall above a sink basin;

a base projecting from the mounting wall and having a downward facing air dryer outlet opening, for supporting components of the apparatus above the sink basin when the mounting wall is secured to the rest room wall over the sink basin;

a blower/dryer fixed on said base for heating air drawn in the region of said base, wherein said blower/dryer has a downward facing air outlet passage in registration with the air dryer outlet opening in said base, and said air outlet passage faces in the direction of one washing/drying position below an open end of the outlet passage at which position a person will place their hands for both washing and drying by the apparatus, the blower/dryer being operative to propel heated air through the air outlet passage toward the one washing/drying position;

a spray head, a part of which is fixed in the air outlet passage of the blower/dryer, the spray head comprising a rinse water inlet in communication with a rinse water outlet, and a soap inlet in communication with a soap outlet, wherein the rinse water and the soap outlets each face in the direction of the one washing/drying position below the open end of the air outlet passage of the blower/dryer to direct a spray of water and a hand soap selectively toward said one position;

a water conduit arrangement including a valve for diverting water supplied by an outside water supply to communicate with the rinse water inlet of the spray head;

a soap reservoir tank including a pump supported on the base for containing a supply of said hand soap, wherein said tank is in communication with the soap inlet of the spray head;

a sensor fixed on said base to detect the presence of a person's hands at the one washing/drying position below the open end of the outlet passage of said blower/dryer; and a timing circuit coupled to said sensor, for sequentially activating the pump of the soap reservoir tank, the valve of the water conduit arrangement, and the blower/dryer over corresponding operating cycles of preset durations while a person's hands are held at the one washing/drying position.

4. Hand sanitizing apparatus according to claim 3, including a box assembly constructed and arranged to be joined between said mounting wall and said restroom wall and at least one pipe section for supporting said box assembly and said mounting wall at a certain height above the sink basin, wherein the pipe section is joined at a top end to said box assembly , and is joined at a bottom end to a counter top of the sink basin.

5. Hand sanitizing apparatus according to claim 4, wherein said water conduit arrangement is routed through said pipe section to connect with the outside water supply, and to communicate water from said water supply to the spray head of the apparatus.

6. Hand sanitizing apparatus according to claim 4, including electrical leads routed through said pipe section for connecting components mounted on the means base means of the apparatus with an outside electrical power source.

7. Hand sanitizing apparatus according to claim 3, wherein said spray head is in the form of one body having two passages communicating between corresponding ones of said inlets and said outlets of the spray head.

8. Hand sanitizing apparatus according to claim 3, wherein said spray head is fixed on a wall forming the air outlet passage of the blower/dryer.

9. Hand sanitizing apparatus according to claim 3, wherein said spray head is mounted at least partly within the air outlet passage of the blower/dryer.

10. Hand sanitizing apparatus according to claim 3, wherein said timing circuit includes a switch arrangement for enabling manual activation of at least one of said pump of said soap reservoir tank, the valve of the water conduit arrangement, and the blower/dryer.

11. Hand sanitizing apparatus according to claim 3, including a counter for accumulating a total number of operational cycles of the apparatus.

12. Hand sanitizing apparatus according to claim 11, wherein said counter is coupled with said pump of the soap reservoir tank.

13. Hand sanitizing apparatus according to claim 3, wherein said timing circuit is configured for sequentially activating the the pump of the soap reservoir tank, the valve of the water conduit arrangement, and the blower/dryer in the stated order when the person's hands are continuously detected by said sensor.

14. Hand sanitizing apparatus according to claim 13, wherein said timing circuit is configured for activating the valve of the water conduit arrangement over a pre-rinse operating cycle prior to an operating cycle of said pump of the soap reservoir tank.

15. Hand sanitizing apparatus according to claim 3, wherein said water conduit arrangement includes a water supply line constructed and arranged to connect to said outside water supply, a rinse water supply line, and said valve has an inlet port connected to said water supply line and an outlet port connected to said rinse water supply line, for directing rinse water to said spray head through the rinse water supply line according to operation of said timing circuit.

16. Hand sanitizing apparatus according to claim 3, wherein said water conduit arrangement includes a hot water supply line and a cold water supply line each constructed and arranged to connect to said outside water supply, a rinse water supply line, and said valve has inlet ports connected to said hot water and said cold water supply lines, and an outlet port connected to said rinse water supply line, for directing warm rinse water to said spray head through the rinse water supply line according to operation of said timing circuit.

17. Hand sanitizing apparatus according to claim 3, wherein said timing circuit is configured for setting within a predetermined range at least one of (a) the duration of the operating cycle of said pump of the soar reservoir tank, (b) the duration of the operating cycle of said valve of the water conduit arrangement, and © the duration of the operating cycle of said blower/ dryer.

* * * * *